US006270273B1

(12) United States Patent
Ohba

(10) Patent No.: US 6,270,273 B1
(45) Date of Patent: Aug. 7, 2001

(54) LIQUID COSMETIC CONTAINER

(75) Inventor: Atsushi Ohba, Tokyo (JP)

(73) Assignee: Suzuno Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/581,425

(22) PCT Filed: Mar. 25, 1998

(86) PCT No.: PCT/JP98/01321

§ 371 Date: Jun. 13, 2000

§ 102(e) Date: Jun. 13, 2000

(87) PCT Pub. No.: WO99/44464

PCT Pub. Date: Sep. 10, 1999

(30) Foreign Application Priority Data

Mar. 2, 1998 (JP) ..... 10-063932

(51) Int. Cl.[7] ..... A46B 11/00; A46B 17/18

(52) U.S. Cl. ..... 401/122; 401/127; 401/126; 401/129

(58) Field of Search ..... 401/118, 119, 401/121, 122, 126–130

(56) References Cited

U.S. PATENT DOCUMENTS 4,241,743 * 12/1980 Schnabel et al. ..... 401/122
4,609,300 * 9/1986 Robert ..... 401/122

FOREIGN PATENT DOCUMENTS 61-14329 5/1986 (JP) .
61-14330 5/1986 (JP) .
61-17699 5/1986 (JP) .
61-20974 6/1986 (JP) .
61-124207 8/1986 (JP) .
61-38500 11/1986 (JP) .
3-88409 9/1991 (JP) .
7-213335 8/1995 (JP) .
7-246112 9/1995 (JP) .
8-10043 1/1996 (JP) .
8-4889 2/1996 (JP) .
11-4714 * 1/1999 (JP) .

* cited by examiner

*Primary Examiner*—David J. Walczak
*Assistant Examiner*—Tuan Nguyen
(74) *Attorney, Agent, or Firm*—Rabin & Champagne, P.C.

(57) ABSTRACT

A liquid cosmetic container which has a secure mechanism for defining the limit of the aperture regulation of a remover 13 is provided. In addition, the degree of aperture of the remover 13 is not influenced by the operation of putting or removing a cap 3. The liquid cosmetic container is provided with the cap 3, and an aperture-regulating ring 7 engages with an upper outer face of a container main body 19. A neck 5 which has an aperture regulating section 11 on the rear end moves in an axial direction in response to rotations of the aperture-regulating ring 7, thereby varying the diameter of a central aperture 119 of the remover 13. Furthermore a rotation-limiting piece 103 extends from a lower end of the aperture-regulating ring 7 and a rotation-limiting projection 136 is provided on an outer face of the container main body 19 which is under an engaging surface of the aperture-regulating ring 7. The rotation of the aperture-regulating ring 7 is regulated by the contact of the rotation-limiting piece 103 with the rotation-limiting projection 136.

22 Claims, 13 Drawing Sheets

LIQUID COSMETIC CONTAINER

TECHNICAL FIELD

The present invention relates to a liquid cosmetic container for mascara, eyeliner, lip-gloss or the like. More particularly, it relates to a liquid cosmetic container provided with an applicator, such as a brush, which is freely insertable and retractable and a remover which has an aperture to remove excess cosmetics adhered to the applicator. The liquid cosmetic container can regulate the amount of cosmetics adhered to the applicator by the regulation of the diameter of the aperture of the remover.

BACKGROUND ART

Many kinds of this type of liquid cosmetic containers which can vary the amount of cosmetics to be removed are known in the art. Usually such a container has structure which can vary the degree of aperture of a remover by the vertical movement of an aperture regulation part to be in contact with the remover in the container. However this type of liquid cosmetic container has the disadvantage that the aperture regulation part moves and the degree of aperture unexpectedly varies due to torque applied to the neck when putting or removing the cap.

A similar application for a type of container which varies the degree of aperture of the remover by the tip of an aperture-regulating ring entails the same problem that when putting the cap, the aperture-regulating ring rotates by the force of tightening the cap or at the final tightening stage.

The present invention has an object of providing a liquid cosmetic container which has a remover with a variable aperture to remove excess cosmetics adhered to the applicator and which can regulate the amount of cosmetics adhered to the applicator. Since the liquid cosmetic container of the present invention has simple structure and a small outer diameter and the aperture-regulating ring does not rotate when a user puts the cap on the container in normal use, it has superior design and userfriendliness, as well as good appearance and applicability to additive decoration.

Furthermore, a liquid cosmetic container is proposed which has a reliable mechanism for determining the limits (opening and closing limits) of aperture regulation of the remover.

Furthermore a liquid cosmetic container is proposed which surely secures the remover and has superior airtightness.

DISCLOSURE OF THE INVENTION

In order to achieve the above object, the liquid cosmetic container of the present invention comprises a container main body in which liquid cosmetics are contained, a cap which closes an aperture of the container, and a bar shaped applicator which is freely insertable into and retractable from the container main body and which is fixed to the cap. The liquid cosmetic container further comprises, in the container main body, a remover which is formed by a resilient body having a central aperture and which strokes the outer periphery of the bar shaped applicator using the aperture, an aperture-regulating ring which rotates freely about the rotational axis on an upper part of the container main body, and a neck which is movable in an axial direction of the container main body in response to the rotation of the aperture-regulating ring and which has an engaging part with the cap. The liquid cosmetic container is adapted to vary the diameter of the central aperture of the remover according to the rotational angle of the aperture-regulating ring.

Preferably the liquid cosmetic container of the present invention comprises the above neck which can slide freely in the vertical direction and which cannot rotate with respect to the main body, and provides an aperture regulation section at a lower end section of the neck. The neck is moved in an axial direction due to the spiral engagement of the neck with the aperture-regulating ring. This preferably creates pressure of the aperture regulation section on the remover and the diameter of the central aperture of the remover is varied.

In other words, there is no relative rotation between the neck and the main body and even if torque is applied when the cap is engaged with the neck, the neck will not rotate with respect to the container main body, and therefore a state of the aperture regulated will not vary.

The liquid cosmetic container of the present invention preferably comprises a means for limiting the relative rotation of the aperture-regulating ring and the container main body to a predetermined range. In the liquid cosmetic container of the present invention, the diameter of the central aperture is determined by the position of the neck in an axial direction. That position is determined by the angle of rotation of the aperture-regulating ring. Therefore in order to determine the opening and closing limits, there are a method of limiting the movement of the neck in the axial direction and a method of limiting the rotational angle of the aperture-regulating ring. In the former, depending on the structure of the aperture regulating mechanism, there is a danger that when the user applies a force and turns the aperture-regulating ring being in the regulated limiting range, a separating force may be applied to the composite section of the mechanism due to the force (thrust force) in the axial direction applied to the neck. On the other hand, there is no such danger as regards the method of limiting the rotational angle of the aperture-regulating ring.

In the liquid cosmetic container of the present invention, the aperture-regulating ring engages with an upper outer circumference of the container main body. A rotation-limiting piece extends from the lower end of the aperture-regulating ring. A rotation-limiting projection is provided on an outer face of the container main body which is under the engagement surface of the aperture-regulating ring. It is preferable that the rotation of the aperture-regulating ring is regulated by the contact of the rotation-limiting piece with the rotation-limiting projection.

In this way, it is possible to surely determine a rotational limit of the aperture-regulating ring. Furthermore manufacture and assembly of components is easy and the user can understand easily whether the aperture-regulating ring is at the rotational limit by viewing the position of an aperture regulation piece.

The actual liquid cosmetic container of the present invention comprises a container main body into which liquid cosmetics are contained, a bar shaped applicator which is freely insertable into and retractable from the container main body, a cap which closes an aperture of the container and which is fixed to the applicator, a neck which is disposed on the top of the container main body and which has an engaging section with the cap, a remover, disposed on the top of the container main body and comprised of a resilient member having a central aperture, for stroking the outer periphery of the bar shaped applicator by means of the aperture, an aperture regulation section, extending from a lower section of the neck, which abuts with the remover and varies the diameter of the central aperture, and an aperture-regulating ring which is rotatably engaged with the container main body and threadably engaged with the neck. A synchronous engagement section is provided between the container main body and the neck in order for the container main body and the neck to freely slide in a vertical direction and to be synchronously engaged with each other. The neck and the aperture regulation section are moved vertically by the rotation of the aperture-regulating ring with respect to the container main body and thus the degree of aperture of the central aperture of the remover is varied.

BEST MODE FOR CARRYING OUT THE INVENTION

Figure 1A:
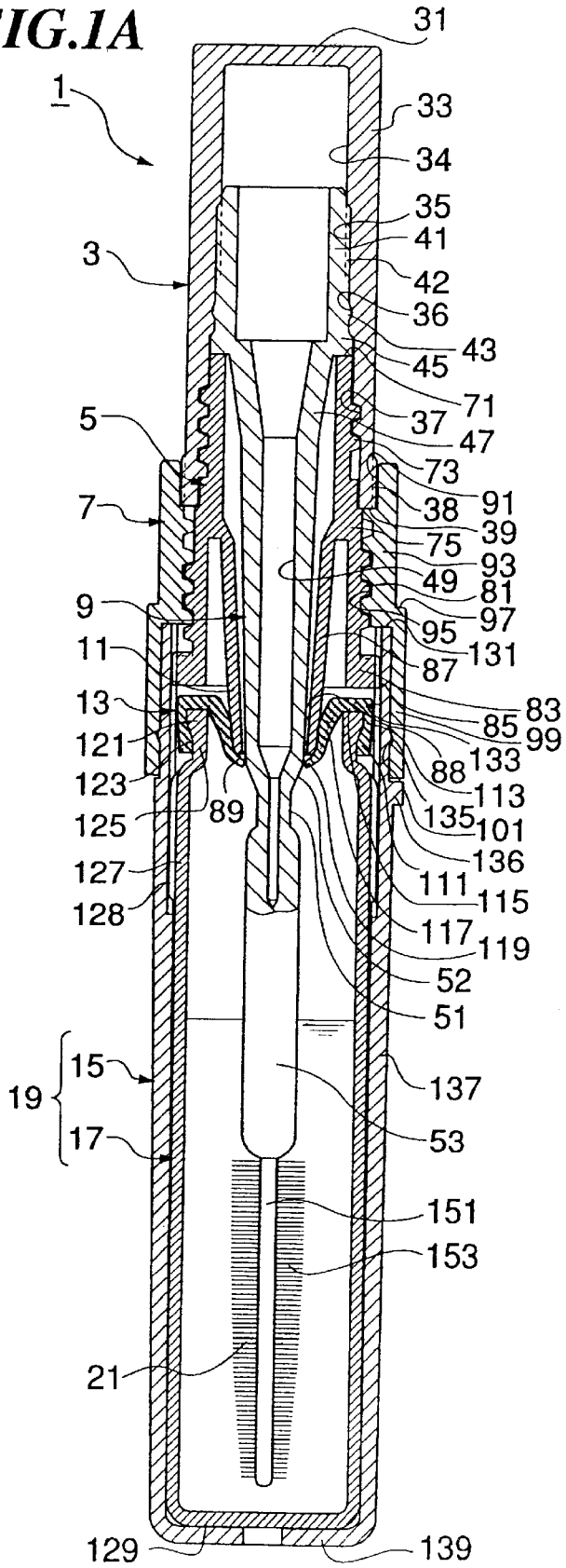
FIG. 1(A) is a cross section showing the internal structure of a liquid cosmetic container according to a first embodiment of the invention in which the remover aperture is in the maximum open state with the aperture regulation part being in the lowered position.
Figure 1B:
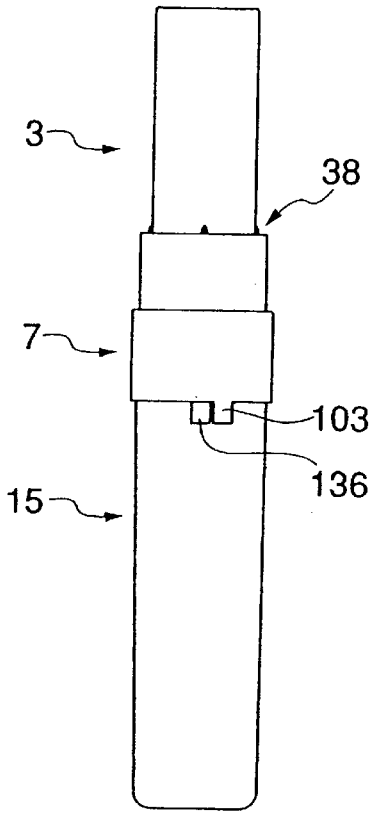
FIG. 1(B) is a similar side view.
Figure 2A:
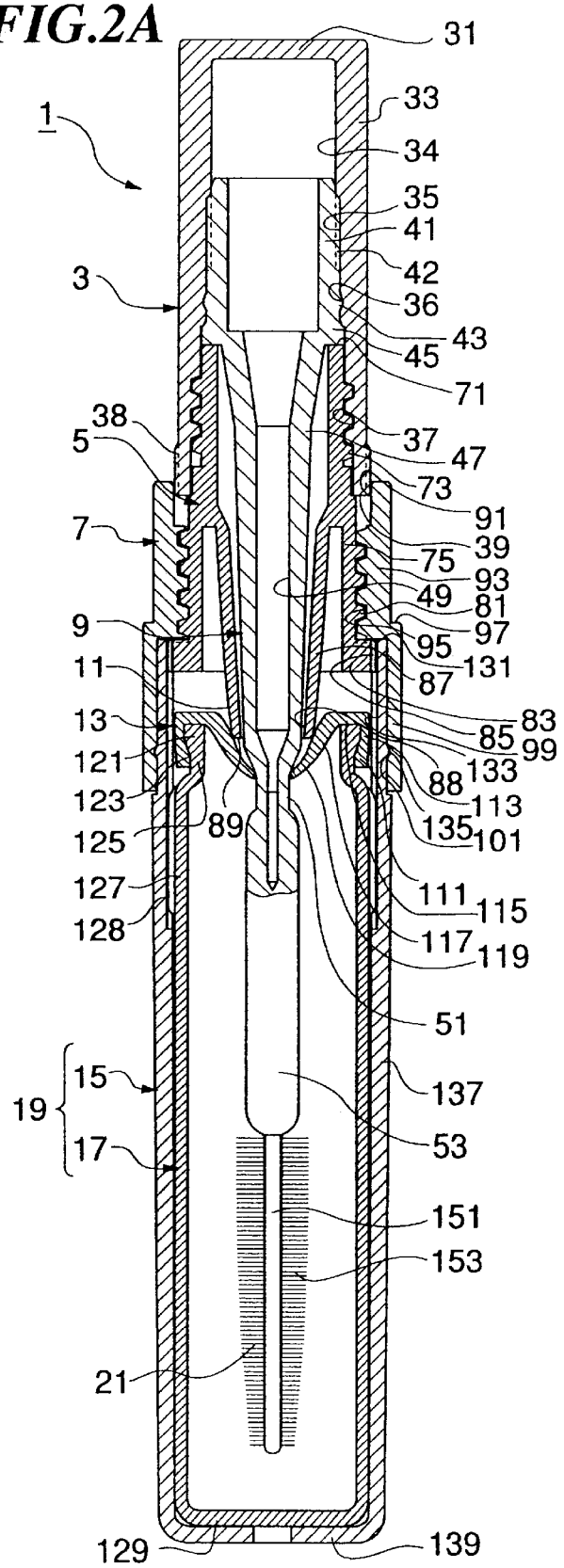
FIG. 2(A) is a cross section of the internal structure of a liquid cosmetic container according to the first embodiment of the invention in which the aperture is in the minimum open state with the aperture regulation part being in the raised position.

FIGS. 1 and 2 show the internal structure of a liquid cosmetic container according to a first embodiment of the present invention. FIG. 1 shows the remover aperture in the maximum open state with the aperture regulation section lowered. FIG. 2 shows the remover aperture in the minimum open state with the aperture regulation section raised. Figure (A) is a cross section and Figure (B) is a side view of the rotation-limiting piece, respectively.

The liquid cosmetic container 1 in these drawings is comprised of a cap 3, a neck 5, a bar shaped applicator 9, an aperture-regulating ring 7, a remover 13, container main body 19 and the like.

FIGS. 3–7 are partial lateral cross sections showing details of the neck, the aperture-regulating ring, the remover, and a bottle and a cover of the container main body of a liquid cosmetic container according to the embodiment.

The container main body 19 has double structure of a cover 15 with a bottle 17 on its inside. The bottle 17 is of a cylindrical shape with a bottom piece which is comprised of a bottom 129 and a lateral section 127 and stores liquid cosmetics in its interior. The cover 15 covers the outside of the bottle 17 and likewise has a bottom 139 and a lateral section 137.

Figure 7A:
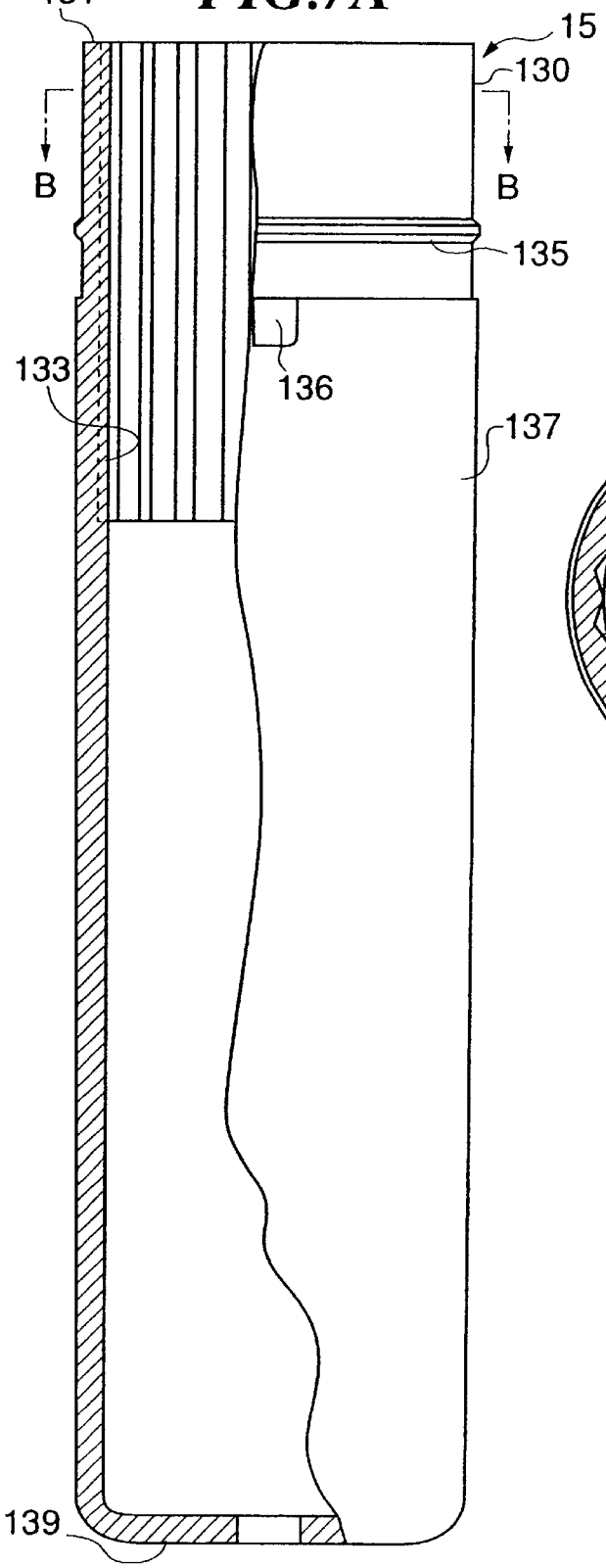
FIG. 7(A) is a partial side cross section showing a detail of a cover of a container main body of a liquid cosmetic container according to the first embodiment of the invention.
Figure 7B:
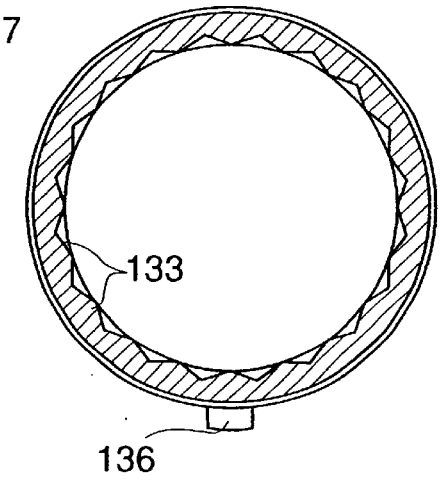
FIG. 7(B) is a similar plan view.

The upper end of the cover 15 extends upwardly to a position higher than the upper end of the bottle 17. A longitudinal synchronous engagement groove 133 which extends in a vertical direction is cut into the inner face of the cover 15. A longitudinal synchronous engagement rib 85 of the neck 5 engages with the longitudinal synchronous engagement groove 133. This rib 85 can slide vertically in the longitudinal synchronous engagement groove 133. The longitudinal synchronous engagement groove 133 is triangular in cross section as shown in FIG. 7(B) and a plurality of the grooves 133 are provided on the circumference at a fixed pitch (in this embodiment, there are 20 pieces).

Four longitudinal ribs 128 formed on the outer surface of the aperture of the bottle 17 engage with the longitudinal synchronous engagement grooves 133. Thus the cover 15 and the bottle 17 are secured in such a manner that they cannot rotate.

An upper outer surface 130 (an aperture-regulating ring engaging surface) of the cover 15 has a cylindrical shape, and the diameter of the upper outer surface 130 of the cover 15 is slightly smaller than those of the other parts of the cover 15. Further, the upper outer surface 130 engages with the aperture-regulating ring 7. Furthermore the ring shaped projection 135 is formed on the upper outer surface 130. A ring shaped dent 101 which is formed on a lower inner face of the aperture-regulating ring 7 engages with the projection 135 and rotatably connects the aperture-regulating ring 7 to the container main body 19.

A rotation-limiting projection 136 is provided on an outer circumference of the cover 15. The outer circumference is under the engaging surface 130 of the aperture-regulating ring. The projection 136 is an approximately square cube as shown in FIG. 7(A) and one projection is provided on the outer circumference in this embodiment. Needless to say, the present invention is not limited to the position, the number and the shape of projections given in the embodiment. The rotation-limiting projection 136 and the rotation-limiting piece 103 of the aperture-regulating ring 7 (to be discussed below) are disposed on the same horizontal surface so as to abut with each other. The rotation-limiting projection 136 limits the rotation of the aperture-regulating ring 7 with respect to the container main body 19 as discussed below.

Figure 6:
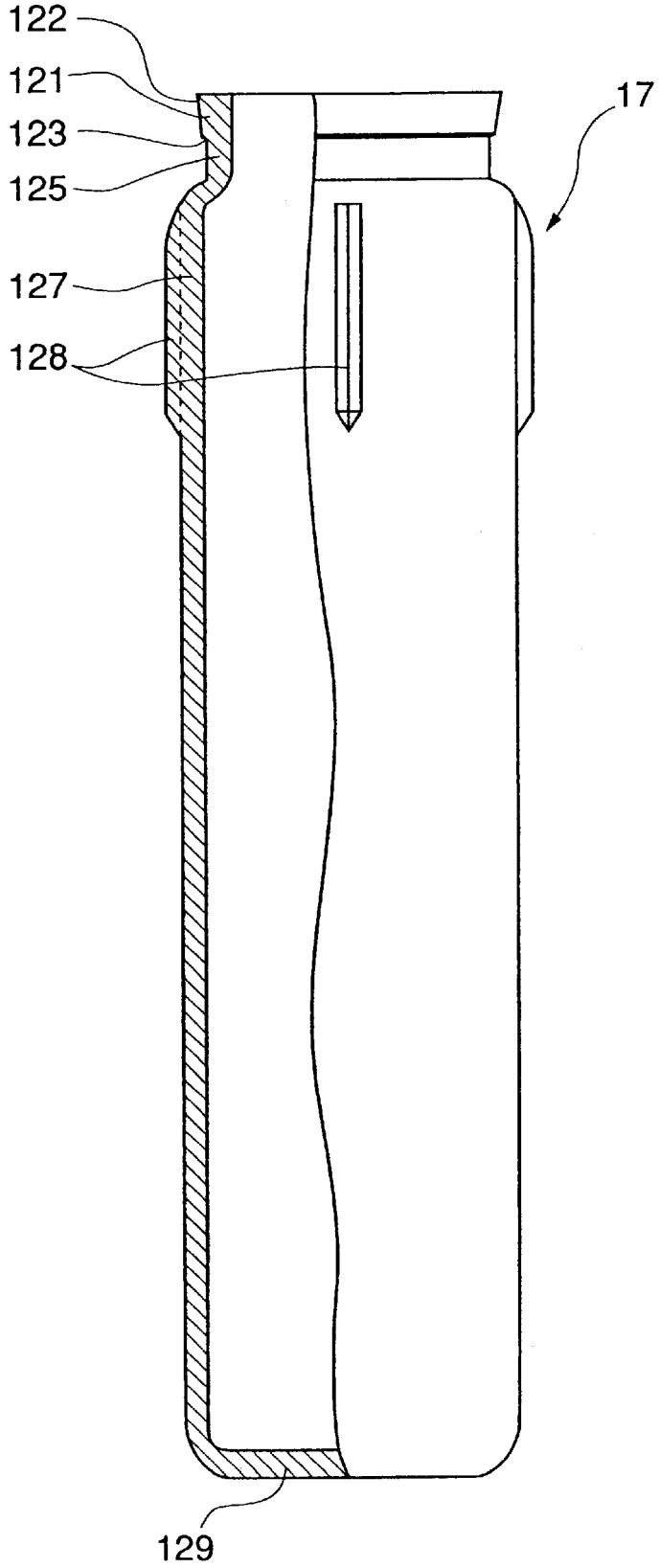
FIG. 6 is a partial side cross section showing a detail of a bottle of a container main body of a liquid cosmetic container according to the first embodiment of the invention.

As shown in detail in FIG. 6, the aperture 121 on an upper end of the bottle 17 has a small diameter at its neck section 125. The outer circumference 122 of the aperture 121 is formed in the shape of an inverted tapering cone and is adapted to prevent the remover 13 from detaching. The lower part of the aperture 121 forms the neck section 125 shaped like a ring groove. A step 123 exists between the aperture 121 and the neck section 125. The shape of the bottle aperture is related to the fixation structure of the remover 13 to be discussed below. The four longitudinal ribs 128 mentioned above are formed on the outer surface of the bottle 17.

The remover 13 is made from an elastic material typified by a rubber such as NBR and expands freely to some extent. The remover 13 is provided with a funnel section 117 which tapers downwardly and has a central aperture 119, an upper hem 115 which extends horizontally towards the outside from an upper end of the funnel section, a suspended section 113 which extends downwardly from an outer edge of the upper hem 115, and a return 111 which extends approximately towards the lower inner side from the suspended section 113. The remover 13 is disposed and set on the bottle aperture 121 in the bottle 17 in a state that the return 111 engages with the neck section 125 and the suspended section 113 engages with the outer circumference of the bottle aperture 121 which is the tapering face 122. In this case, the funnel section 117 abuts with the inner side of the bottle aperture 121 in the bottle 17. Furthermore the inner peripheral edge 11 la of the return 111 is hooked to the step 123 which is above the neck section 125 and prevents detachment.

With regard to the remover 13, the upper inner circumference of the cover 15 presses against the suspended section 113 of the remover 13 from the outside and tightly secures the remover 13.

That is to say, the return 111 of the remover 13 is maintained in a sandwiched position between the bottle aperture 121 and the cover 15. Thus the remover 13 is tightly fixed to the container main body 19 and the airtightness of the bottle is increased.

The aperture regulating section 11 of the neck 5 abuts with an upper section of the funnel section 117 of the remover 13 from above. When the aperture regulating section 11 is in a high position, the funnel section 117 closes inwardly due to its own elasticity and reduces the remover aperture 119 which is an aperture provided at the center of the remover 13. When the aperture regulating section 11 is in a low position, a tip 89 of the aperture regulating section 11 depresses the funnel section 117, the funnel section 117 opens outwardly due to elasticity and thus the remover aperture 119 is widened.

The aperture-regulating ring 7 is adapted so that an upper cylindrical section 93 of small diameter and a lower cylindrical section 99 of large diameter are connected at a step 97 on an outer surface of the aperture-regulating ring 7. The lower cylindrical section 99, as stated above, is rotatably connected to an outer upper surface of the container main body 19. The inner side of the step 97 is almost in contact with an upper end 131 of the cover 15. The ring shaped dent 101 stated above is formed on an inner face of the lower cylindrical section 99. A female screw 95 is formed on an inner face of the upper cylindrical section 93 and a male screw 81 formed on an outer circumference of the neck 5 is spirally engaged with the female screw 95. The female screw 95 has a single thread with a relatively small lead and, as described in detail below, is provided so that the neck (the aperture regulating section 11) moves between the upper and lower limiting positions when the aperture-regulating ring 7 makes an approximately single rotation. An upper inner surface 91 of the female screw 95 is a level circumferential inner surface. On the surface 91, a longitudinal rib 38 on an outer circumference of the lower end of the cap 3 rotates without contacting with the surface 91. That is to say, the cap 3 widens the aperture of the remover 13 by sinking into the inner diameter of the aperture-regulating ring 7 due to the rotation of the aperture-regulating ring 7.

The rotation-limiting piece 103 extends from a lower end of the aperture-regulating ring 7. The rotation-limiting piece 103 is an approximately square cube and is disposed on the same horizontal surface as the rotation-limiting projection 136 on an outer surface of the cover 15 discussed above.

The neck 5 has a cylindrical shape with male screws 73 and 81 (a group of male projections may also be used) in two vertical positions. The cylindrical aperture regulating section 11 which tapers slightly and downwardly is integrated into the central section 75 so as to extend downwardly and inwardly. The tip 89 of the aperture regulating section 11 as discussed above abuts with an inner surface of the funnel section 117 of the remover 13 and regulates the degree of aperture of the remover aperture 119. The outer surface of the aperture regulating section 11 is formed as a slightly and downwardly tapered section and is adapted to slide and abut without resistance with respect to the tapered surface of the inner surface of the funnel section 117 of the remover 13. A dent 86 is provided on the outer peripheral section of the base 87 of the aperture regulating section 11. The dent 86 is for the purpose of preventing a sink mark when performing plastic injection molding.

Figure 3A:
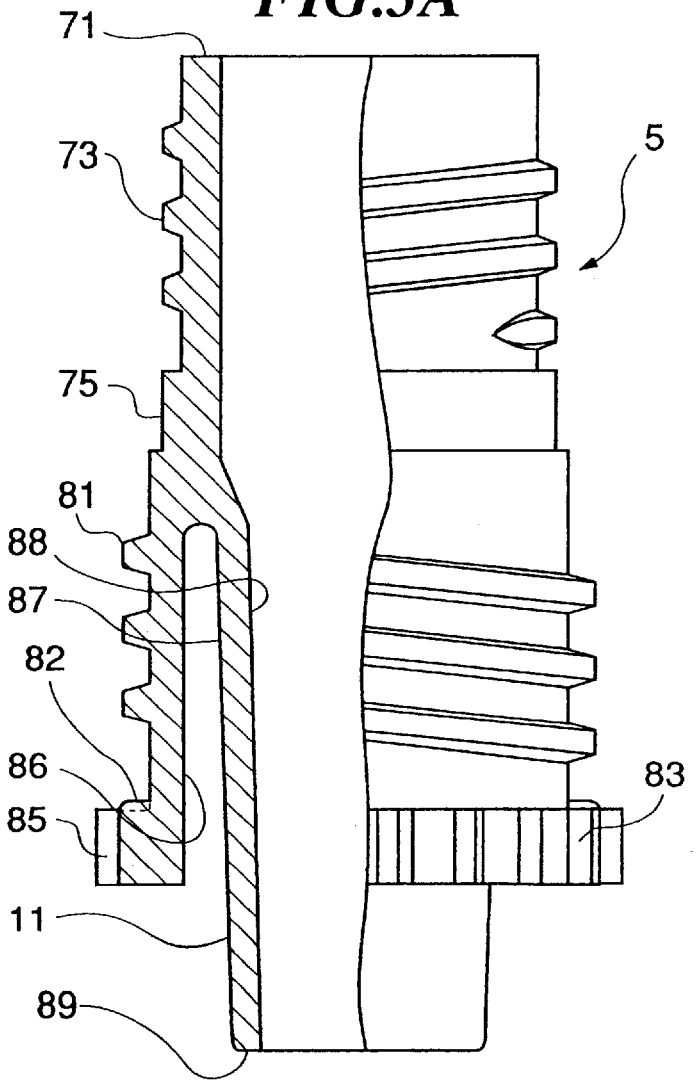
FIG. 3(A) is a partial lateral cross section showing a detail of the neck of the liquid cosmetic container according to the first embodiment of the invention.
Figure 3B:
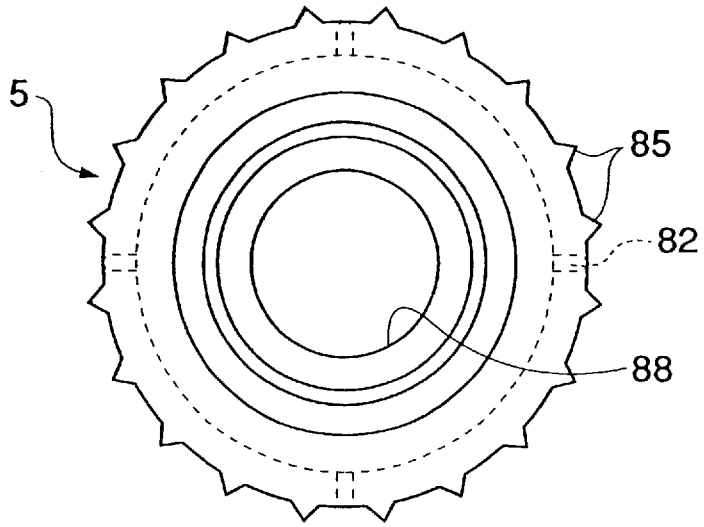
FIG. 3(B) is a similar plan view.
Figure 4:
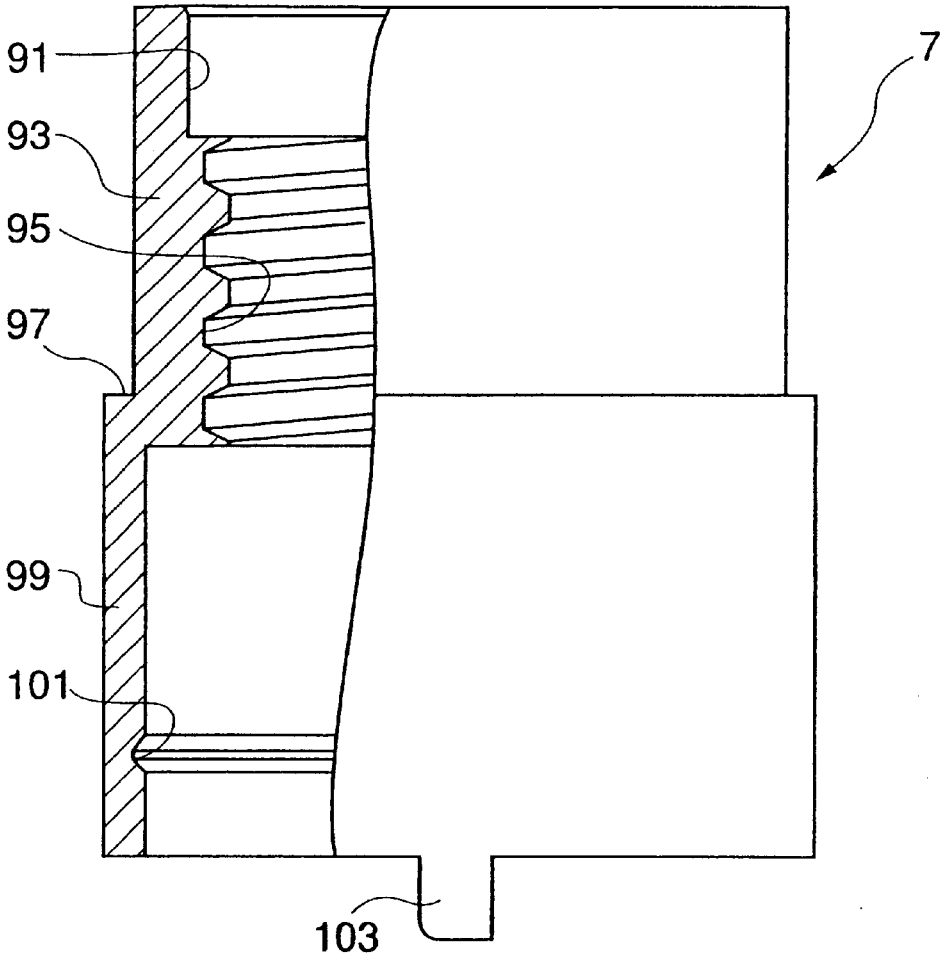
FIG. 4 is a partial side cross section showing a detail of an aperture-regulating ring of a liquid cosmetic container according to the first embodiment of the invention.
Figure 5:
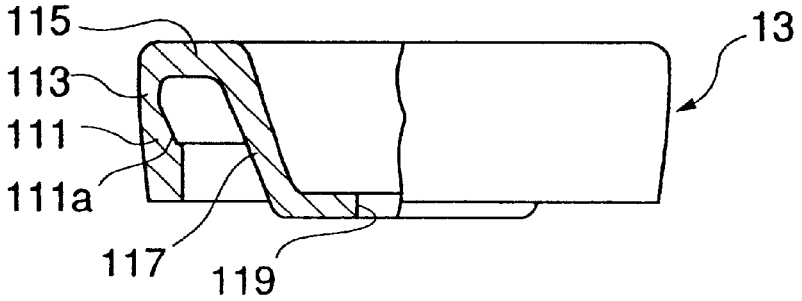
FIG. 5 is a partial side cross section showing a detail of a remover of a liquid cosmetic container according to the first embodiment of the invention.

The male screw 81 formed on an outer surface of the lower step of the neck 5 is a left-hand screw, and the male screw 73 formed on an outer surface of the upper step of the neck 5 is a right-hand screw. As shown in FIG. 3(B), a plurality of longitudinal ribs 85(20 pieces in this embodiment) for synchronous engagement project from an outer circumference of a flange 83 provided under the male screw 81. These longitudinal ribs 85 act as longitudinal synchronous engagement ribs (preventing rotation with respect to the container main body) which synchronously engage with the longitudinal synchronous engagement grooves 133 which are cut on the upper inner surface of the cover 15 of the container main body 19. In other words, the longitudinal ribs 85 enter the longitudinal synchronous engagement grooves 133 and move in a vertical direction along the synchronous engagement grooves 133. Thus when the container main body 19 and the aperture-regulating ring 7 rotate relatively to one another (for example when one is twisted with the other held with one hand), the neck 5 moves vertically with respect to the remover 13 and the container main body 19 to which the remover 13 is fixed. The position of abutment of the remover 13 with the tip 89 of the aperture regulating section 11 on the lower end of the neck 5 varies vertically as a result of the vertical movement of the neck 5, and thus it is possible to regulate the degree of aperture of the remover aperture 119 as described above. Furthermore when the cap 3 is rotated, the neck 5 and the container main body 19 never move relatively to each other.

The relationship between the limitation of rotation by the aperture-regulating ring and the aperture regulation will be explained below. The rotation-limiting projection 136 of the container main body 19 and the rotation-limiting piece 103 of the aperture-regulating ring 7 are disposed on the same horizontal surface. Furthermore as shown in FIG. 1, the lateral faces of the rotation-limiting piece 103 and the rotation-limiting projection 136 are positioned and designed to abut with each other when the aperture regulating section 11 of the neck 5 is in its lower-limit position. The positioning during assembly will be explained below. At this time, the remover aperture 119 of the remover 13 is in the maximum opened position and the open limit is defined. When the container main body 19 and the aperture-regulating ring 7 are rotated relatively to one another, the aperture regulating section 11 moves upwardly. When the aperture-regulating ring 7 is rotated by roughly one turn and the rotation-limiting projection 136 and the rotation-limiting piece 103 are rotated until their lateral surfaces of the opposite side abut with each other, the aperture-regulating ring 7 cannot be rotated any further and the aperture regulating section 11 is at its upper-limit position. At this time, the remover aperture 119 of the remover 13 is closed most and the closed limit is defined.

The open and closed limits are determined so that an appropriate amount of liquid cosmetic is removed and the degree of aperture of the remover aperture 119 at each limit is regulated according to the shape of the aperture regulating section 11, the pitch of the screws of the neck 5 and the aperture-regulating ring 7, and the like. Since the rotation-limiting projection 136 and the rotation-limiting piece 103 are provided on the outer surface of the container main body in this embodiment, the open and closed limits can visually be observed. Furthermore since a gap or looseness will result between the container main body and the aperture-regulating ring if the aperture limiting projection is provided on the inner surface of the container main body, it is preferable to provide this projection on an outer surface. The degree of aperture of the remover aperture 119 can be estimated by looking at the relative position of the rotation-limiting projection 136 and the rotation-limiting piece 103. Thus it is possible to set an appropriate amount of liquid cosmetics which adhere to the brush 21.

The male screw 73 on an upper outer surface of the neck 5 is threadably connected with a female screw 37 of the cap 3. The inner section of the neck 5 is in the form of a hole cut in the vertical direction (an inner hole 88) through which the bar shaped applicator 9 passes. The inner hole 88 narrows towards the lower direction so that the bar shaped applicator 9 may easily be inserted into the container.

An upper end 71 of the neck 5 abuts with a lower surface of the flange 45 of the bar shaped applicator 9 in a state that the cap 3 (fixed to the bar shaped applicator 9) is closed and the inner section of the container main body is sealed.

The bar shaped applicator 9 is a bar shaped member having the brush 21 on its lower end and is provided so as to be freely insertable into and extractable from the container main body 19. The upper section of the bar shaped applicator 9 is in the form of an insertable section 41 which is a hollow cylindrical section with a relatively large diameter. A ring shaped protrusion 43 is formed on the base of this insertable section 41 and when the ring shaped dent 36 on an inner face of the cap 3 engages with the protrusion 43, the cap 3 and the bar shaped applicator 9 are secured. The inner hole of the insertable section 41 is a dent for preventing a sink mark.

The flange 45 is formed under the insertable section 41 of the bar shaped applicator 9. The central step 47 of the bar shaped applicator 9 is a hollow bar shaped section which extends downwardly while gradually tapering. This hollow section is a sink mark prevention hole 49. A contracted section 51 which is remarkably narrowed is formed under the central step 47. When the bar shaped applicator 9 is inserted in the container 1 and the cap 3 is put, the remover aperture 119 of the remover 13 moves to the contracted section 51 and a tapering section 52 which is above the contracted section 51. In FIG. 2, the remover aperture 119 is at its tightest position (contracts in a central direction) and, in contrast, a section of the bar shaped applicator 9 with which the remover aperture 119 comes into contact is in its narrowest position accordingly. In FIG. 1, the remover aperture 119 is at its widest position and a section of the applicator 9 with which the remover aperture 119 comes into contact is also at its widest position. Although the liquid cosmetic is sealed in the container due to the contact (tightening) of the remover aperture 119 with an outer circumference of the bar shaped applicator 9, the above structure maintains an appropriate tightening force.

The lower step 53 of the bar shaped applicator 9 is in the shape of a solid bar. The brush 21 composed of brush hair 153 and a guide 151 is connected to the bottom of the lower step 53. When the brush 21 with which liquid cosmetics are soaked is extracted from the container main body 19 and passes through the remover aperture 119 of the remover 13, the brush hair 153 is stroked and excess liquid cosmetics adhered to the brush hair 153 are removed and fall back into the container main body 19. The strength of the stroke is determined according to the degree of aperture of the remover aperture 119. Thus, by regulating the degree of aperture of the remover aperture 119 by the mechanism discussed above, it is possible to regulate the amount of liquid cosmetics adhered to the brush 21.

The cap 3 is in the form of a cylinder with an apex which is composed of lateral sections 33 and a top 31. The female screw 37 is formed on the lower section of an inner surface 34. The female screw 37 is threadably connected with the male screw 73 formed on an upper outer surface of the neck 5. The cap 3 is mounted on the container 1. At this time, a bottom end 39 of the cap 3 is engaged with the upper inner face 91 of the aperture-regulating ring 7.

The insertable section 41 of the bar shaped applicator 9 is fixed to the central step of the cap 3 as stated above. More precisely, the ring shaped dent 36 is formed on an inner surface of the central step of the cap 3. The ring shaped protrusion 43 which is provided above the flange 45 of the bar shaped applicator 9 engages with the ring shaped dent 36 and the cap 3 and the bar shaped applicator 9 are secured. Furthermore the cap 3 and the bar shaped applicator 9 are prevented from rotating by the engagement of the longitudinal rib 42 on an outer surface of the insertable section 41 of the bar shaped applicator 9 with the longitudinal groove 35 on an upper inner surface of the cap 3.

The assembling process of the liquid cosmetic container according to FIG. 1 will now be explained.

Figure 2B:
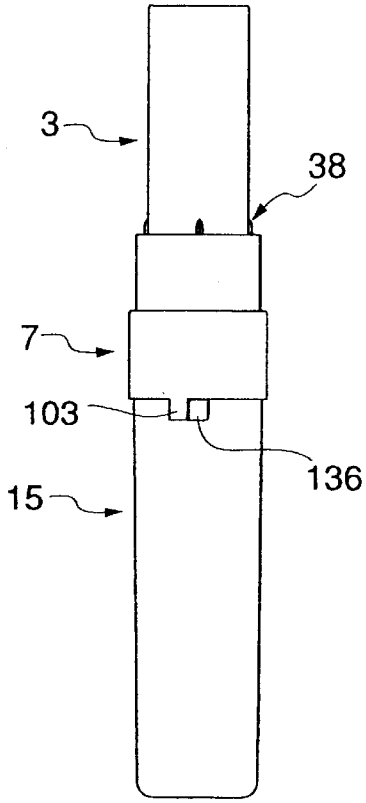
FIG. 2(B) is a similar side view.

First the remover 13 is mounted on the aperture of the bottle 17. Then the bottle 17 is placed in the cover 15 to form the container main body 19. The neck 5 is placed in the aperture-regulating ring 7 from below. As shown in FIG. 2, the neck 5 is screwed in until it reaches the upper limit in the aperture-regulating ring 7. The rotation-limiting piece 103 of the aperture-regulating ring 7 is assembled in the cover 15 in a position as shown in FIG. 2(B), that is to say, in a position that the rotation-limiting piece 103 roughly abuts with the left side of the rotation limiting projection 136 of the cover 15 and in such a manner that the ribs 85 of the neck 15 are engaged with the grooves 133 of the cover 15. The ring shaped dent 101 of the aperture-regulating ring 7 and the ring shaped protrusion 135 of the cover 15 are thus engaged and the aperture-regulating ring 7 is brought into rotatable contact with the container main body 19. On the other hand, the bar shaped applicator 9 is fitted into and integrated with the cap 3. The integrated cap 3 and bar shaped applicator 9 are inserted into the assembled container main body described above and assembly is complete.

The overall operation including the mechanism for regulating the amount of liquid cosmetics adhered to the applicator in the liquid cosmetic container shown in FIG. 1 will be explained below.

During use, the cap 3 together with the applicator 9 is twisted, separated from the neck 5, and the bar shaped applicator 9 is removed from the container. At this time, liquid cosmetics in the container main body 19 are adhered to the brush 21 at a lower end of the applicator 9. However, when the brush 21 passes through the remover aperture 119 of the remover 13, the brush 21 is stroked (squeezed) and excess cosmetics adhered thereto are removed and fall back into the container main body 19.

The degree of aperture of the remover aperture 119 of the remover 13 is regulated as follows. When the container main body 19 is gripped in the fingers and the aperture-regulating ring 7 is rotated, the male screw 81 of the neck 5 and the female screw 95 on an inner face of the aperture-regulating ring 7 are rotated relatively to one another since the neck 5 rotates synchronously with the container main body 19. In this way, the neck 5 is pushed by the aperture-regulating ring 7 which is vertically connected with the container main body 19 and moves in a vertical direction with respect to the container main body 19. When the neck 5 moves vertically, the funnel section 117 of the remover 13 is pushed by an outer face of the aperture regulating section 11 at a lower section of the neck 5 and the degree of aperture which widens outwardly from the center varies. In this way, the diameter (degree of aperture) of the remover aperture 119 which is the central aperture of the remover 13 varies.

In other words, when the neck 5 is in a high position (refer to FIG. 2), the diameter of the aperture of the remover 13 decreases and the remover aperture 119 forms a closed limit. The brush 21 is strongly stroked, thereby reducing the amount of cosmetics which are adhered to the brush 21 extracted from the container. On the other hand, when the neck 5 is in a low position (refer to FIG. 1), the diameter of the aperture of the remover 13 increases and the remover aperture forms an open limit. The brush 21 is not stroked very strongly, thereby increasing the amount of cosmetics which are adhered to the brush 21 extracted from the container.

The container main body 19 and the aperture-regulating ring 7 are only rotated less than a single turn due to the rotation-limiting action of the rotation-limiting projection 136 of the container main body 19 and the rotation-limiting piece 103 of the aperture-regulating ring 7. The distance of vertical movement of the neck 5 is limited and the open limit and the closed limit of the remover aperture 119 are determined. A user is able to estimate the degree of aperture of the remover aperture 119 by knowing the relative positions of the rotation-limiting projection 136 and the rotation-limiting piece 103.

Figure 8A:
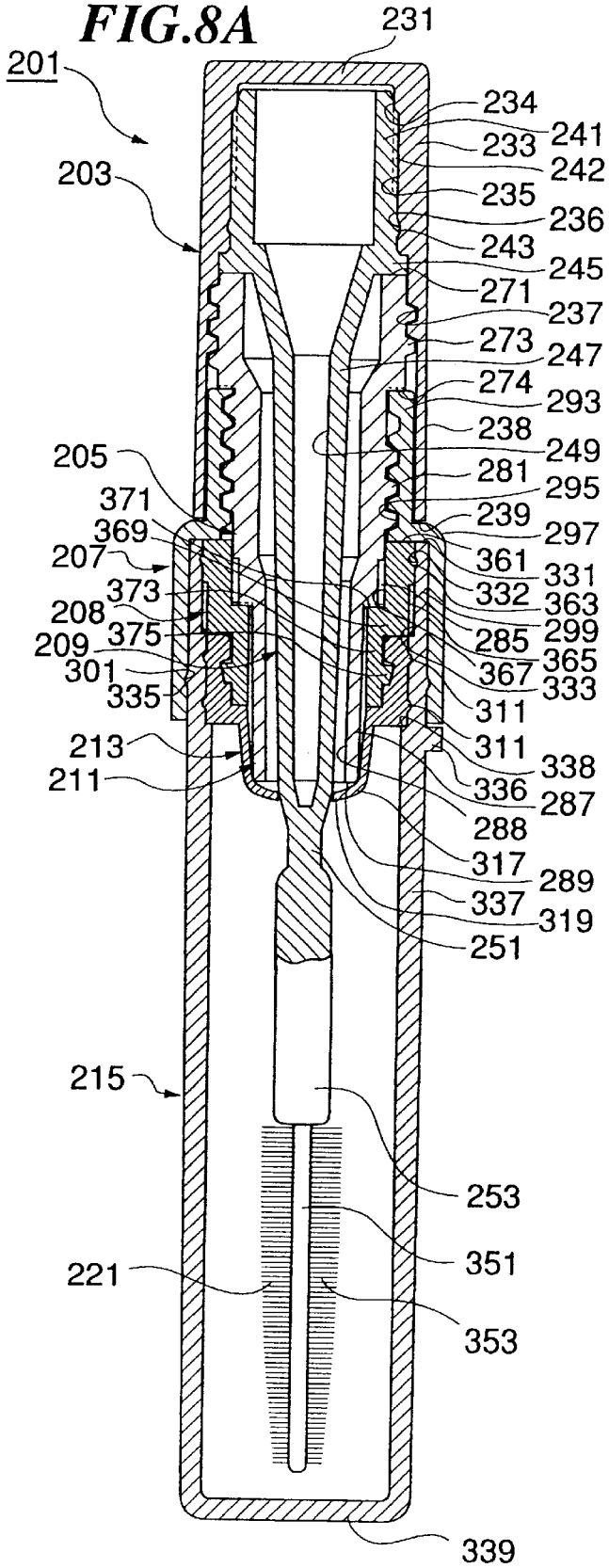
FIG. 8(A) is a cross section showing the internal structure of a liquid cosmetic container according to a second embodiment of the invention in which the aperture is in the maximum open state with the aperture regulation part being in the lowered position.
Figure 8B:
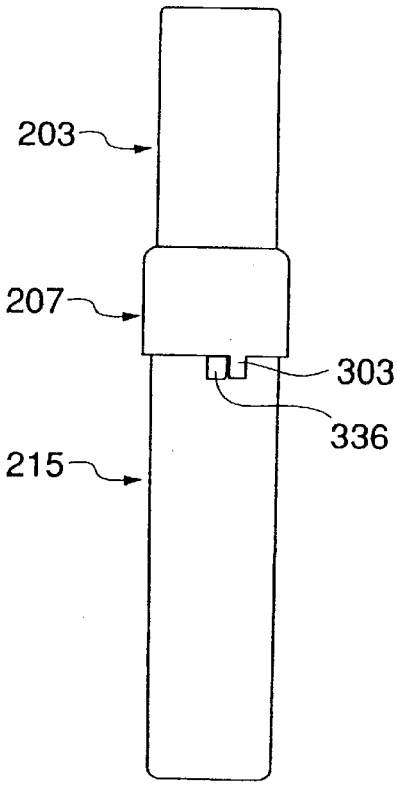
FIG. 8(B) is a similar side view.
Figure 9A:
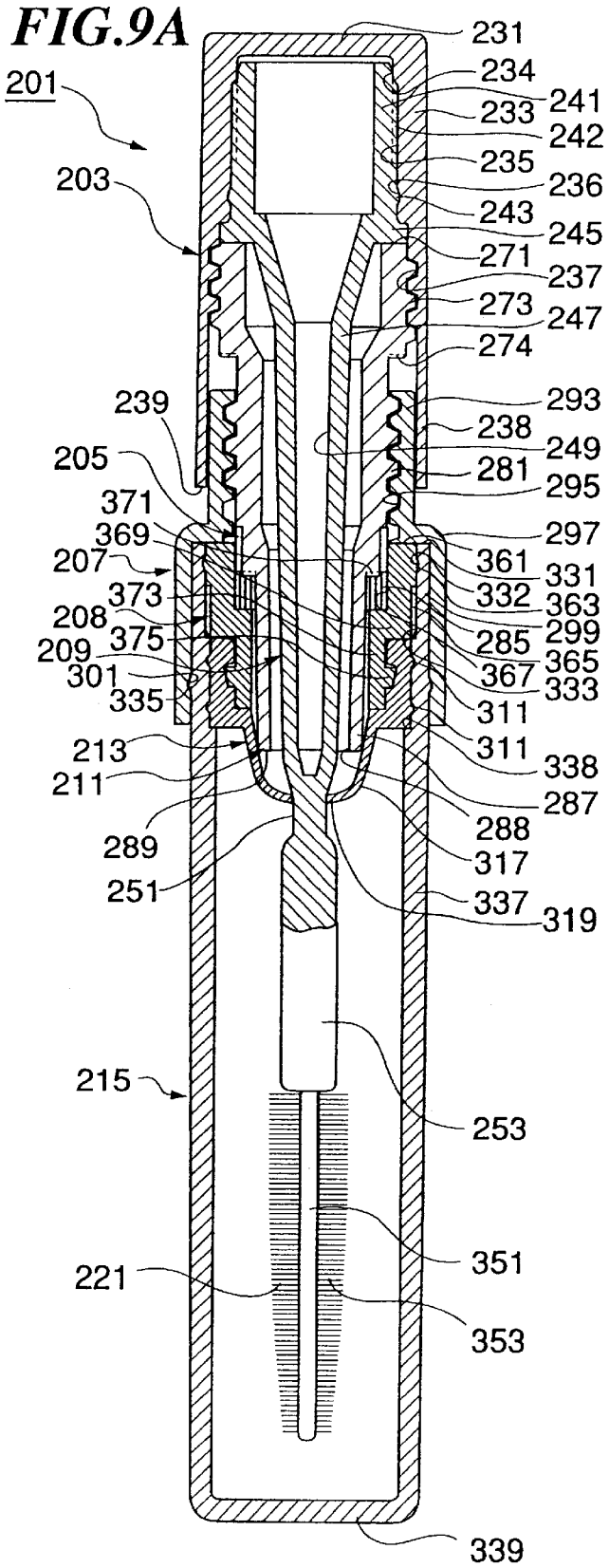
FIG. 9(A) is a cross section showing the internal structure of a liquid cosmetic container according to the second embodiment of the invention in which the remover aperture is in the minimum open state with the aperture regulation part being in the raised position.
Figure 9B:
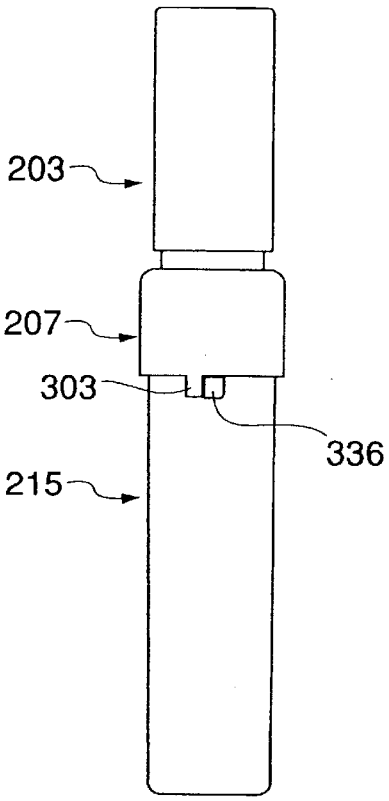
FIG. 9(B) is a similar side view.
Figure 10A:
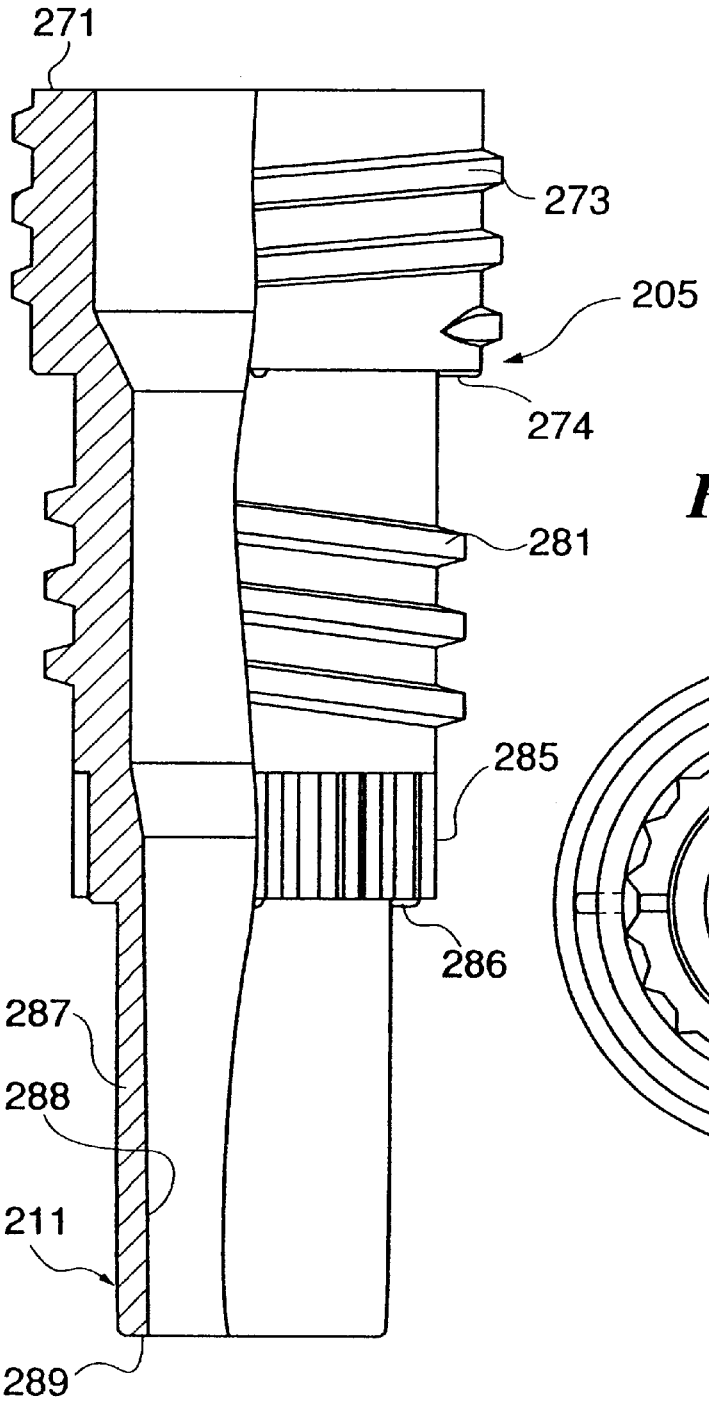
FIG. 10(A) is a partial side cross section showing a detail of the neck of the liquid cosmetic container according to the second embodiment of the invention.
Figure 10B:
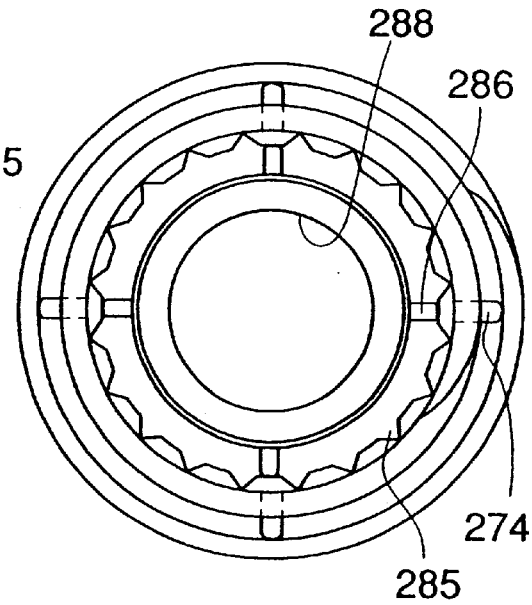
FIG. 10(B) is a similar plan view.
Figure 11:
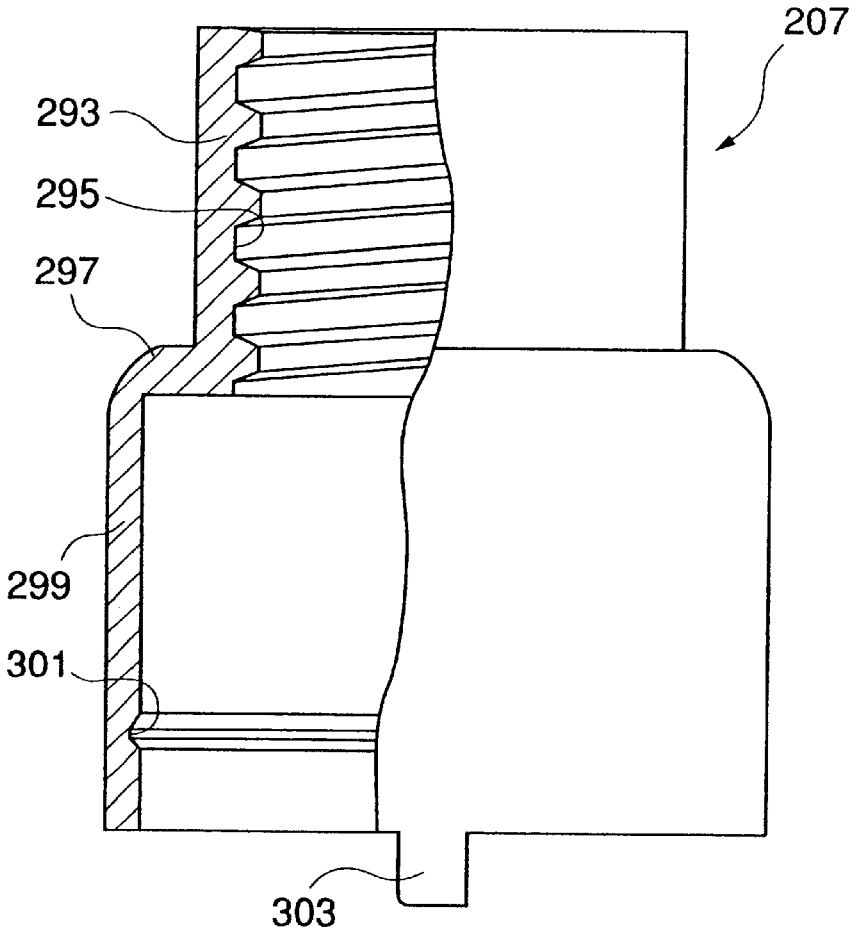
FIG. 11 is a partial side cross section showing a detail of an aperture-regulating ring of a liquid cosmetic container according to the second embodiment of the invention.
Figure 12:
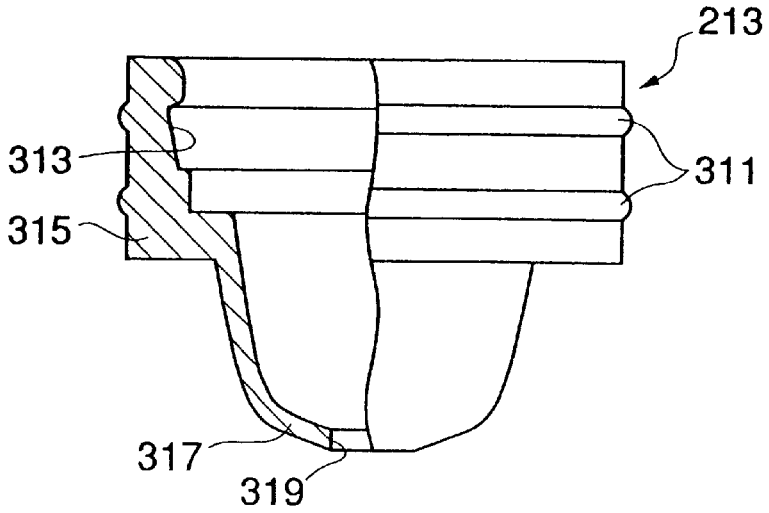
FIG. 12 is a partial side cross section showing a detail of a remover of a liquid cosmetic container according to the second embodiment of the invention.
Figure 13A:
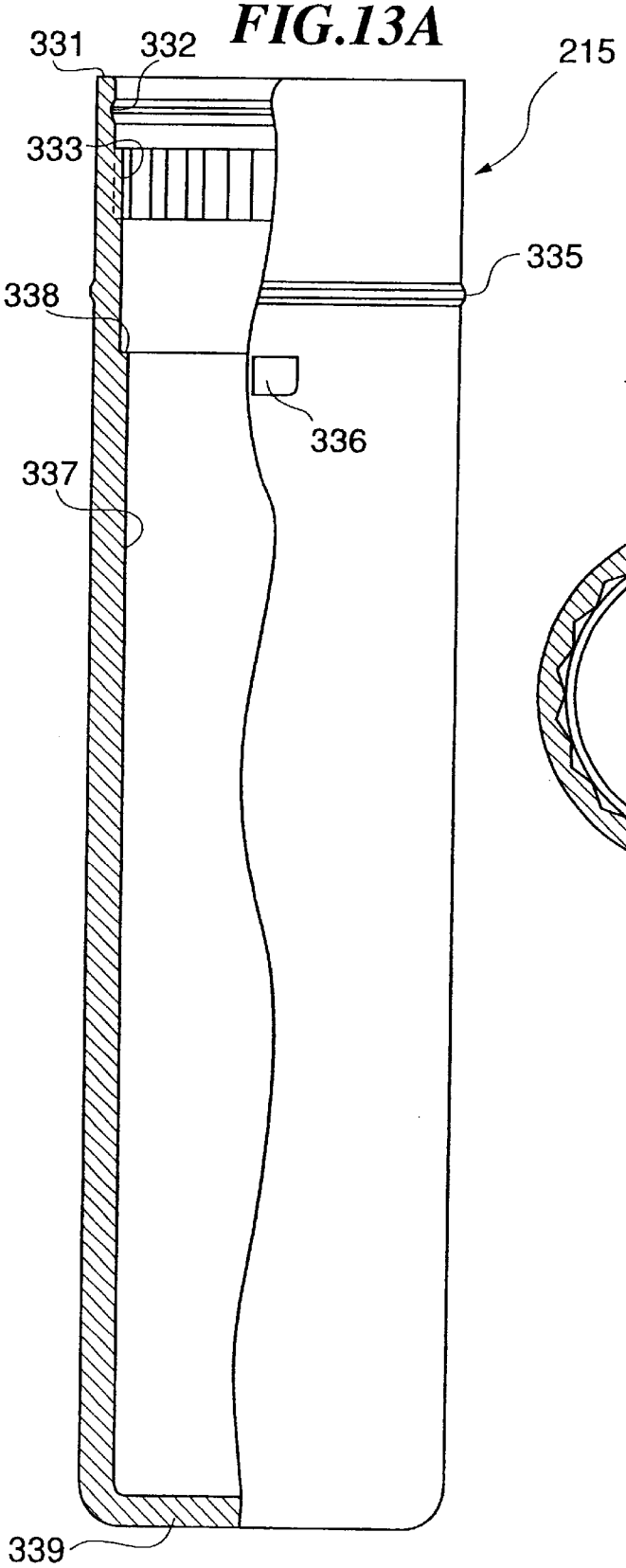
FIG. 13(A) is a partial side cross section showing a detail of a bottle of a container main body of a liquid cosmetic container according to the second embodiment of the invention.
Figure 13B:
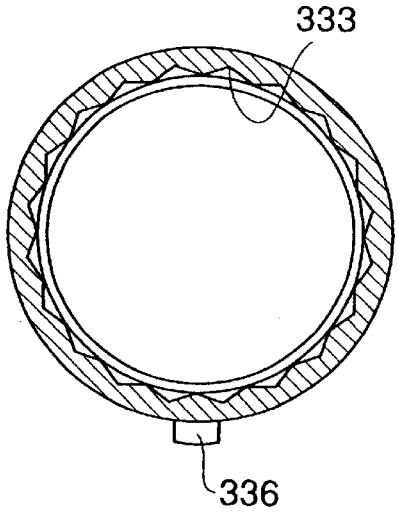
FIG. 13(B) is a similar plan view.
Figure 14A:
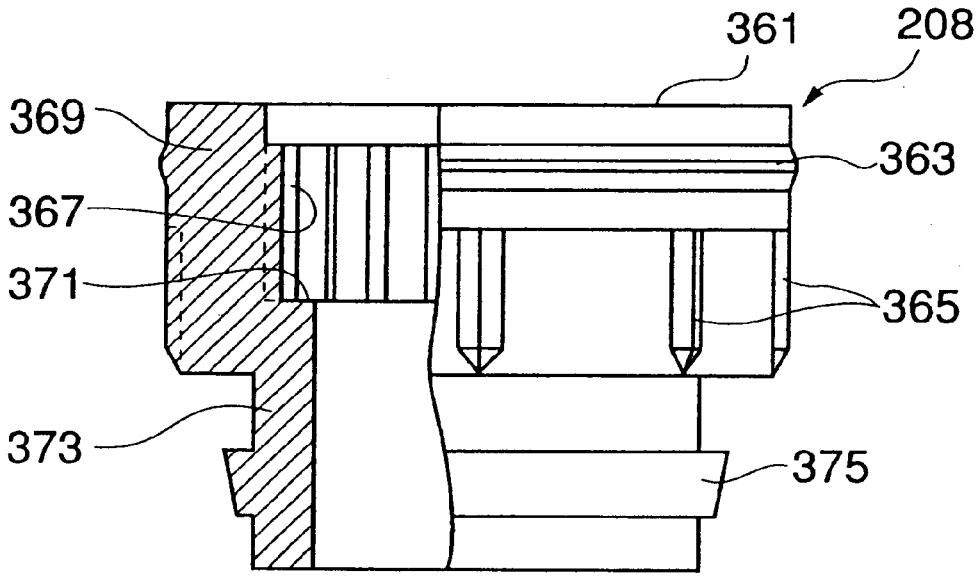
FIG. 14(A) is a partial side cross section showing a detail of a support ring of a liquid cosmetic container according to the second embodiment of the invention.
Figure 14B:
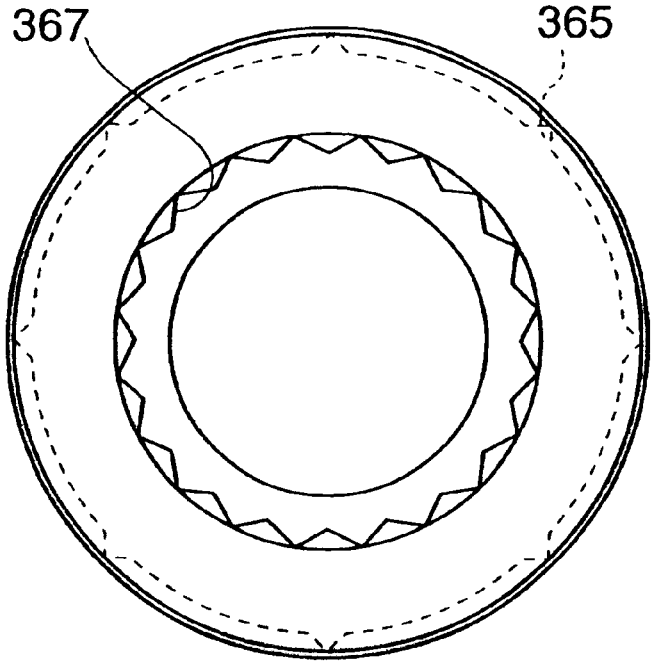
FIG. 14(B) is a similar plan view.

FIGS. 8 and 9 are cross sections showing the inside structure of a liquid cosmetic container according to a second embodiment of the present invention. FIG. 8 shows the remover aperture at its open limit with the aperture regulating section depressed. FIG. 9 shows the remover aperture at its closed limit with the aperture regulating section raised. Figure (A) is a cross section and Figure (B) is a side view of the rotation-limiting piece.

FIGS. 10–14 are partial cross sections showing details of a support ring, container main body, remover, aperture-regulating ring, and neck of a liquid cosmetic container according to the second embodiment.

In these figures, reference numerals made by adding numeral 200 to the reference numerals of FIG. 1 indicate the components and parts same as those of FIG. 1 excluding those specified hereinafter.

The liquid cosmetic container of the second embodiment differs from that of the first embodiment mainly in the following points.

(1) A container main body 215 is a single bottle.

It is possible to reduce costs by the use of a single bottle. The aperture of the container main body 215 is not narrowed, whereby the container main body 215 is cylindrical as a whole. As a result, the means below is employed to secure the remover to the aperture of the container main body 215.

A longitudinal synchronous engagement groove 333 which extends in a vertical direction is cut on an upper inner face of the container main body 215. A longitudinal synchronous engagement rib 365 of a support ring 208 whose detailed explanation is given below is engaged with the longitudinal groove 333. A ring shaped dent 332 is formed on an upper end inner face of the container main body 215 and engages with a ring shaped protrusion 363 of the support ring 208. Thus the support ring 208 is secured to an inner face of the container main body 215 and is not able to rotate. An upper end face 361 of the support ring 208 is approximately on the same surface as an upper end face 331 of the container main body 215. A step 338, discussed below, which is used to secure a remover 213 is formed on a lower part of the longitudinal groove 333 provided on an upper inner face of the container main body 215.

(2) There is the support ring 208 for securing the remover 213.

The remover 213 is secured to an inner face of the container main body 215 by the support ring 208. The support ring 208 comprises an upper ring section 369 which is secured to the container main body 215 and a lower ring section 373 which secures the remover 213 by sandwiching it between the container main body 215 and the lower ring section 373.

The upper end face 361 of the upper ring section 369 faces a lower face of a shoulder 297 of an aperture-regulating ring 207 leaving a small space in between. The outer face of the upper ring section 369 engages with an upper inner face of the container main body 215. The ring shaped protrusion 363 is formed on the top and the longitudinal rib 365 is formed on the bottom of the outer face of the upper ring section 369, respectively. The ring shaped protrusion 363 engages with the ring shaped dent 332 of the container main body 215 and prevents the detachment of the support ring 208. The longitudinal rib 365 engages with the longitudinal groove 333 of the container main body 215 and prevents the rotation of the support ring 208. A longitudinal groove 367 is formed on an inner face of the upper ring section 369. A longitudinal rib 285 formed on an outer face of the neck 205 slides in the longitudinal groove 367 in an axial direction and stops a neck 205 from rotating.

The lower ring section 373 of the support ring 208 engages with an inner face of the remover 213. A ring shaped protrusion 375 protrudes from an outer face of the lower ring section 373. The protrusion of the upper section of the ring shaped protrusion 375 is high and that of the lower section is low. The outer circumference face is in the form of a surface which tapers downwardly. The ring shaped protrusion 375 is inserted into a ring shaped dent 313 of an upper inner face of the remover 213, and it secures the inner circumference of the remover 213 composed of an elastic material in such a manner that the inner circumference is lifted. The shape of the ring shaped protrusion 375 has the effect of preventing the remover 213 from detaching downward.

(3) The shape of the remover 213 is different.

The remover 213 made from an elastic compressible material is provided with a funnel section 317 which tapers downwardly and which has a central aperture 319 and a ring section 315 which extends upwardly from an outer periphery of the funnel section 317. The ring shaped dent 313 is formed on an inner face of the ring section 315. As discussed above, the ring shaped protrusion 375 of the lower ring section 373 of the support ring 208 engages with the ring shaped dent 313 and prevents detachment. Furthermore two ring shaped protrusions 311 are formed on the upper and lower sides of the outer face of the ring section 315 and they press against the inner face of the container main body 215, thereby increasing airtightness. The step on the lower side of the ring section 315 sits on the step 338 of an inner face of the upper section of the container main body 215 mentioned above. In this way, the ring section 315 of the remover 213 is gripped between an upper section of the container main body 215 and the lower ring section 373 of the support ring 208, whereby it is securely fixed without being detached. Also, the sealing performance of the outer face of the remover 213 is further ensured.

(4) A cap 203 is formed to overlap with an upper face of an upper section 293 of the aperture-regulating ring 207 due to the vertical movement of the cap 203 and in this respect it differs from the embodiment in FIGS. 1 and 2.

(5) The means of assembling the device differs from the embodiment shown in FIGS. 1 and 2 in that the neck 205 is assembled from the top of the aperture-regulating ring 207.

Firstly the support ring 208 which secures the remover 213 is inserted in the container main body 215. Next the neck 205 is fully screwed into the aperture-regulating ring 207. The aperture-regulating ring 207 is engaged with the container main body 215 in a state that a rotation-limiting piece 303 of the aperture-regulating ring 207 and a rotation-limiting projection 336 of the container main body 215 are fully open. If the aperture-regulating ring 207 and the container main body 215 are rotated in the opposite direction, the rotation-limiting piece 303 and the rotation-limiting projection 336 will meet and will be in a fully closed position. Detachment of the neck 205 from the aperture-regulating ring 207 is prevented by the contact of the rotation-limiting piece 303 with the rotation-limiting projection 336.

Figure 15A:
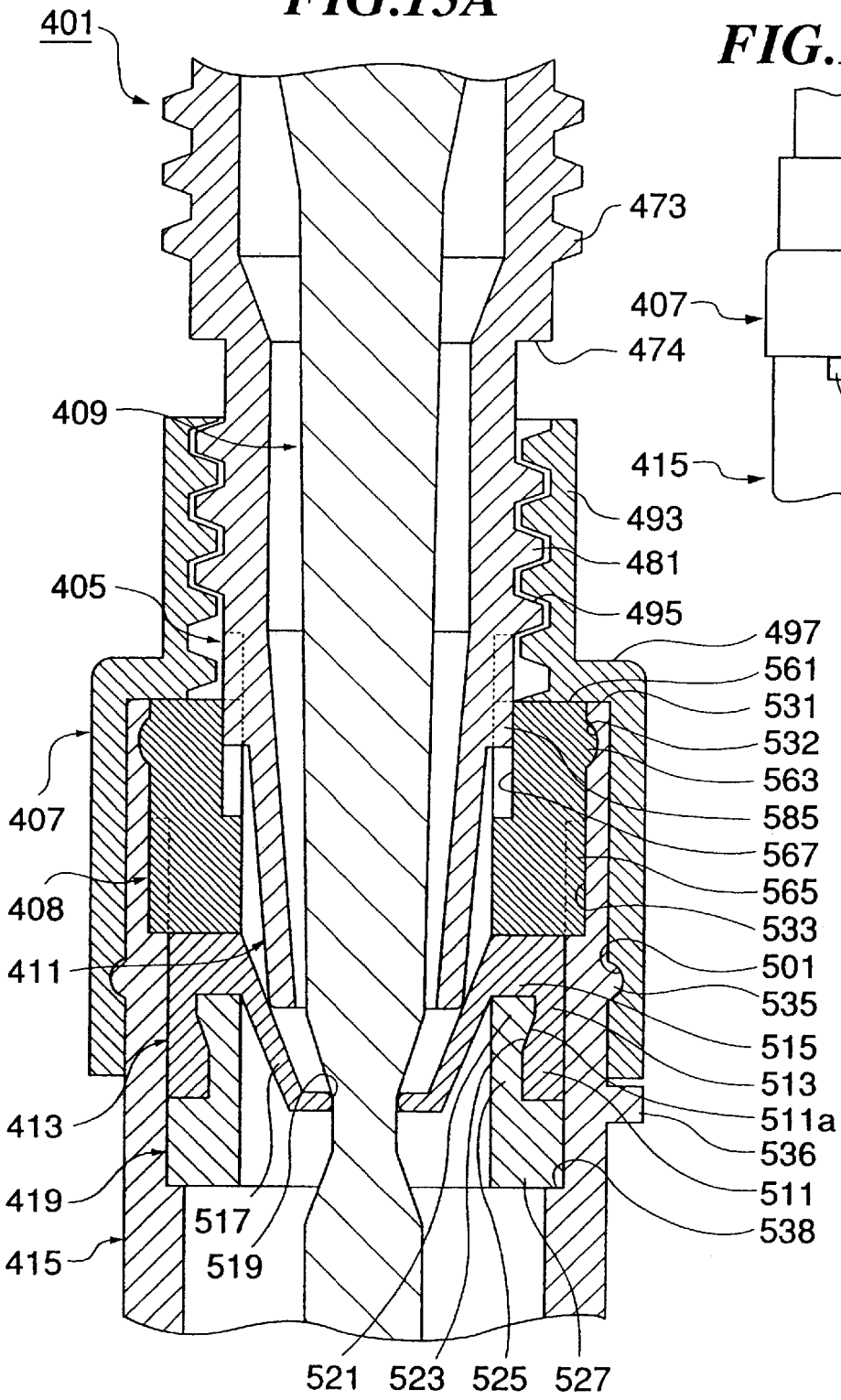
FIG. 15(A) is a cross section showing the internal structure of the main components of a liquid cosmetic container according to a third embodiment of the invention in which the remover aperture is in the maximum open state with the aperture regulation part being in the raised position.
Figure 15B:
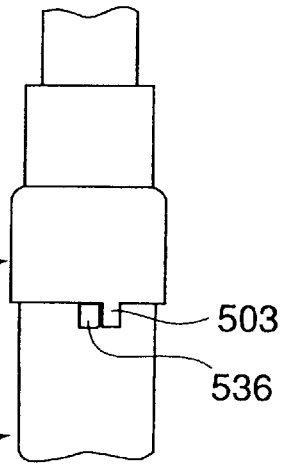
FIG. 15(B) is a similar side view.

FIG. 15 is a cross section showing the inner structure of the main components of a liquid cosmetic container according to a third embodiment of the present invention. It shows the remover in a fully open position with the aperture regulating section lowered. FIG. 15(A) is a partial cross section; FIG. 15(B) is a partial side cross section. In the figures, reference numerals made by adding numeral 200 to the reference numerals in the second embodiment indicate components and parts same as those in the second embodiment excluding those specified hereinafter.

A liquid cosmetic container 401 according to the third embodiment comprises a container main body 415 into which liquid cosmetics are contained, a bar shaped applicator 409 which is freely insertable into and retractable from the container main body 415, a cap which closes the aperture of the container main body 415, a neck 405 which is disposed at an upper section of the container main body 415 and which has a section to be engaged with the cap, a remover 413, made from a resilient material and disposed at an upper section of the container main body 415, which has a central aperture and squeezes the outer circumference of the bar shaped applicator 409 using the aperture, an aperture regulating section 411 which extends from a lower section of the neck 405 and abuts with the remover 413, thereby varying the degree of aperture of the central aperture, and an aperture-regulating ring 407 which is rotatably engaged with the container main body 415 and which is threadably engaged with the neck 405. A synchronous engagement section is provided between the container main body 415 and the neck 405 in order for the container main body 415 and the neck 405 to freely slide in a vertical direction and to be synchronously engaged with each other. The neck 405 and the aperture regulating section 411 are moved in a vertical direction by the rotation of the aperture-regulating ring 407 with respect to the container main body 415 and thus the degree of aperture of the central aperture of the remover 413 is varied. The remover 413 is composed of a downwardly tapering member which has a central aperture and a ring section which extends downwardly from an outer circumference of the member. The remover 413 is secured by being gripped by an upper support ring 408 which abuts with an upper end of the ring section and a lower support ring 419 which abuts with an inner face of the ring section.

In other words, the remover 413 is securely fixed to the aperture of the container main body 415 by being gripped from above and below by the upper and lower support rings 408 and 419. Due to this type of arrangement, the remover 413 is pressured, whereby the airtightness between its outer face and the inner face of the container main body 415 is further improved.

Longitudinal grooves 533 for synchronous engagement which extend in a vertical direction are cut on an upper inner face of the container main body 415. Longitudinal ribs 565 for synchronous engagement provided on the upper support ring 408 engage with the longitudinal grooves 533. Furthermore a ring shaped dent 532 is formed on an inner face of the upper end of the container main body 415 and engages with the ring shaped protrusion 563 provided on the upper supporting ring 408. Thus the upper support ring 408 is unrotatably fixed on an inner face of the container main body 415.

The lower support ring 419 is in the shape of a bottle neck and comprises a lower ring section 527 and a neck section 525 which extends upwardly from the lower ring section 527. The outer circumference of the neck section 525 is slightly indented. The lower ring section 527 is mounted on a step 538 of an inner face of the container main body 415.

The remover 413 is formed from an elastic material typified by a rubber such as NBR and expands freely to an extent. The remover 413 is provided with a funnel section 517 which tapers downwardly and has a central aperture 519, an upper hem 515 which extends outwardly and horizontally from an upper end of the funnel section 517, a suspending section 513 which slightly extends downwardly from the outer periphery of the upper hem 515, and a return 511 which extends downwardly and inwardly from the suspending section 513. The remover 413 is set and mounted on a bottle aperture 521 in a state that the suspending section 513 engages with an outer circumference of the tapering face of the bottle aperture 521 and the return 511 engages with the neck section 525 with the funnel section 517 against the inner side of the bottle aperture 521. An edge section 511 a of an inner circumference of the return 511 is hooked on a step 523 provided above the neck section 525, thereby functioning to prevent the detachment.

The upper inner circumference of the container main body 415 pushes the suspending section 513 of the remover 413 from outside. Thus the remover 413 is securely attached, whereby the airtightness is further heightened.

During assembly, firstly the remover 413 is engaged with the aperture 521 of the lower support ring 419 from above and the remover 413 and lower support ring 419 are assembled. The lower support ring 419 assembled is inserted from the upper aperture of the container main body 415 and mounted on a step 538 provided on an inner face of the container main body 415. The remover 413 is gripped between an inner face of the container main body 415 and the lower support ring 419. Next the upper support ring 408 is fitted from the upper aperture of the container main body 415. The longitudinal ribs 565 of the upper support ring 408 engage with the longitudinal grooves 533 of the container main body 415, and the ring shaped protruding section 563 of the upper support ring 408 is engaged with the ring shaped dent 532 of the container main body 415. The upper support ring 408 is fixed in a non-rotatable state in the container main body 415. In this embodiment, the remover 413 is fixed by being gripped from above and below by the upper support ring 408 and the container main body 415. Thus the remover 413 is accurately fixed in both the vertical and transverse directions to an inner face of the container main body 415 by the upper support ring 408, the lower support ring 419 and the container main body 415. As a result, the airtightness of the container is improved.

Liquid cosmetics are sold on the basis of characteristics which are mainly divided into the substance being water-based, oil-based or volatile. The common characteristic which pertains to all these substances is that they have a "Dry Out" effect. Thus, liquid cosmetic containers must be excellent in airtightness and userfriendliness. A liquid cosmetic container with a variable remover aperture is provided which is adapted for use with all kinds of liquid cosmetics by the application of the three embodiments explained in the specification.

INDUSTRIAL APPLICABILITY

As explained above, the liquid cosmetic container of the present invention bring about the following effects.

(1) The aperture regulating section forms the lower end of the neck member which engages with the cap. When the cap is put by a user, the aperture-regulating ring does not undergo any undesirable movement irrespective of its rotational angle due to the fact that the aperture regulating section is capable of moving in an axial direction without rotating with respect to the container main body. As a result, a liquid cosmetic container is provided which differs from the prior art and has both excellent userfriendliness and design with a compact size.

(2) It is possible to prevent the breakage or dislocation of the mechanism which may occur due to force (thrust force) in an axial direction applied on the neck by providing the aperture-regulating ring and the container main body with a means which limits the rotation of the aperture-regulating ring and the container main body, respectively.

(3) It is possible to prevent the formation of a gap between the container main body and the aperture-regulating ring by the provision of rotation-limiting members on the respective outer faces of the aperture-regulating ring and the container main body. Furthermore it is possible to use indicators to represent the rotational angles by the letters S, M, L, or the like.

(4) It is possible to provide a liquid cosmetic container which has high airtightness and a remover with a vertical aperture of the cross section and which is applicable to all kinds of liquid cosmetics due to the remover in the form and the method of securing the remover as explained in the above embodiments.

(5) It is possible to use the container main body either in the form of a single bottle or a double bottle which is formed by a cover and a bottle. Thus it is possible to select the desired use of the container on the basis of the manufacturing process or the use. In particular, a single bottle affords a liquid cosmetic container which has an eye-catching appearance.

What is claimed is:

1. A liquid cosmetic container, comprising:

a container main body which contains liquid cosmetics;

a cap which closes an aperture of said container main body; and a bar shaped applicator which is freely insertable into and detachable from said main body and which is fixed to said cap;

wherein a remover, which is composed of an elastic body having a central aperture and strokes an outer portion of said bar shaped applicator by said aperture, is provided in said container main body;

an aperture-regulating ring, which freely rotates about an axial direction of said container main body, is provided at an upper part of said container main body;

a neck, which has a section engaged with said cap and can move in the axial direction in response to rotations of said aperture-regulating ring, is provided;

a diameter of the central aperture of said remover is varied according to a rotational angle of said aperture-regulating ring;

said neck being provided so as to be freely slidable in a vertical direction and non-rotatable with respect to said main body;

an aperture regulating section is provided on a lower end of said neck; and said neck is moved in the axial direction due to spiral engagement of said aperture-regulating ring with said neck and the diameter of the central aperture of said remover is varied in response to pressure of said aperture regulating section on said remover according to the movement of said neck.

2. A liquid cosmetic container according to claim 1, wherein regulation of the diameter of the central aperture of said remover is performed by a rotation of said aperture-regulating ring through an angle of 360° or less.

3. A liquid cosmetic container according to claim 1, wherein means for limiting a rotation of said aperture-regulating ring to a predetermined range are provided between said aperture-regulating ring and said container main body.

4. A liquid cosmetic container according to claim 3, wherein said aperture-regulating ring is engaged with an upper outer circumference of said container main body; a rotation-limiting piece extends from a lower end of said aperture-regulating ring; a rotation-limiting projection is provided on an outer face of said container main body, said outer face is under an engaging face of said aperture-regulating ring; and a rotation of said aperture-regulating ring is limited by contact of said rotation-limiting piece with said rotation-limiting projection.

5. A liquid cosmetic container according to claim 1, wherein said container main body comprises:

a bottle, having an aperture, said remover being placed on the bottle's aperture; and a cover which covers the bottle.

6. A liquid cosmetic container according to claim 1, wherein said container main body is a cylindrical body with a base whose upper section is opened; a support ring which is retained at a step formed at an upper section of an interior of said cylindrical body is further provided; said neck engages with said container main body through said support ring so as to be freely slidable in the vertical direction and non-rotatable; and said remover is fixed to said support ring.

7. A liquid cosmetic container according to claim 1, wherein regulation of the aperture diameter of said remover is performed by a rotation of said aperture-regulating ring through an angle of 360° or less.

8. A liquid cosmetic container according to claim 1, wherein means for limiting a rotation of said aperture-regulating ring to a predetermined range are provided between said aperture-regulating ring and said container main body.

9. A liquid cosmetic container according to claim 8, wherein said aperture-regulating ring is engaged with an upper outer circumference of said container main body; a rotation-limiting piece extends from a lower end of said aperture-regulating ring; a rotation-limiting projection is provided on an outer face of said container main body, said outer face is under an engaging face of said aperture-regulating ring; and a rotation of said aperture-regulating ring is limited by contact of said rotation-limiting piece with said rotation-limiting projection.

10. A liquid cosmetic container, comprising:

a container main body in which liquid cosmetics are contained;

a bar shaped applicator which is freely insertable into and detachable from said container main body;

a cap which closes an aperture of the container main body and is fixed to said applicator;

a neck, disposed on a first upper section of said container main body, which has a section engaged with said cap;

a remover, disposed on a second upper section of said container main body and composed of a resilient material defining a central aperture, for stroking an outer circumference of said bar shaped applicator by the material defining said aperture;

an aperture regulating section which extends from a lower section of said neck, abuts with said remover, and varies a diameter of the central aperture of said remover; and an aperture-regulating ring which rotatably engages with said container main body and spirally engages with said neck, wherein a synchronous engagement section is provided between said container main body and said neck in order for said container main body and said neck to freely slide in a vertical direction and to be synchronously engaged with each other; and said neck and said aperture regulating section are moved in a vertical direction by a rotation of said aperture-regulating ring with respect to said container main body, whereby a degree of aperture of the central aperture of said remover is varied.

11. A liquid cosmetic container according to claim 10, wherein means for regulating rotations of said aperture-regulating ring are further provided, whereby a regulation limit of a diameter of the central aperture of said remover is defined.

12. A liquid cosmetic container according to claim 11, wherein said container main body is a cylindrical body with a base whose upper section is opened; a support ring which is retained at a step formed at an upper section of an interior of said cylindrical body is further provided; said neck engages with said container main body through said support ring so as to be freely slidable in a vertical direction and non-rotatable; and said remover is fixed to said support ring.

13. A liquid cosmetic container according to claim 11, wherein said container main body comprising:

a bottle having an aperture on which said remover is placed; and a cover which covers said bottle.

14. A liquid cosmetic container according to claim 10, wherein said aperture-regulating ring engages with an upper outer circumference of said container main body; a rotation limiting piece extends from a lower end of said aperture-regulating ring; a rotation limiting projection is provided on an outer face of said container main body which is under an engaging surface of said aperture-regulating ring; and rotations of said aperture-regulating ring are regulated by contact of said rotation limiting piece with said rotation limiting projection.

15. A liquid cosmetic container according to claim 10, wherein said container main body comprises:

a bottle having an aperture, said remover being placed on the bottle's aperture; and a cover which covers said bottle.

16. A liquid cosmetic container according to claim 10, wherein said container main body comprising:

a bottle having an aperture on which said remover is placed; and a cover which covers said bottle.

17. A liquid cosmetic container according to claim 10, wherein said container main body is a cylindrical body with a base whose upper section is opened; a support ring which is retained at a step formed at an upper section of an interior of said cylindrical body is further provided; said neck engages with said container main body through said support ring so as to be freely slidable in a vertical direction and non-rotatable; and said remover is fixed to said support ring.

18. A liquid cosmetic container according to claim 17, wherein said remover is composed of a downwardly tapering member which has a central aperture and a ring section which extends in a lower direction from an outer circumference of said remover; an upper support ring which abuts with an upper end of said ring section of said remover and a lower support ring which abuts with an inner face of said ring section of said remover are provided; and said remover is gripped between both of said support rings.

19. A liquid cosmetic container according to claim 18, wherein said upper support ring is fixed to said container main body; and a synchronous engagement section is provided between an inner face of said upper support ring and said neck in order for said upper support ring and said neck to freely slide in a vertical direction and to be synchronously engaged with each other.

20. A container comprising:

a container main body;

a bar shaped applicator having an outer portion, said applicator being adapted to be freely insertable into and detachable from said container main body;

a cap fixed to said applicator;

an aperture-regulating ring disposed at an upper portion of said container main body, and being adapted to rotate about an axis of said container main body;

a remover, disposed in said container main body, and composed of an elastic body having an inner portion defining a central aperture, the aperture having a diameter which is varied according to a rotational angle of said ring, wherein the inner portion of said elastic body is adapted to stroke the outer portion of said applicator;

a neck, engaged with said cap, and movable in an axial direction due to rotation of said ring, said neck being freely slidable in the axial direction and non-rotatable with respect to said container main body; and an aperture-regulating section, disposed on a lower portion of said neck, and being adapted to apply a pressure to said remover based on rotation of said ring, wherein said neck is spirally engaged with said ring, rotation of said ring varies the pressure applied by said aperture-regulating section to said remover, and varying the pressure applied by said aperture-regulating section to said remover varies the diameter of said aperture.

21. The container of claim 20, wherein said container is adapted to contain a liquid.

22. The container of claim 21, wherein the liquid is a cosmetic.

* * * * *